US008919913B2

(12) United States Patent
Maeshima

(10) Patent No.: US 8,919,913 B2
(45) Date of Patent: Dec. 30, 2014

(54) INKJET IMAGE FORMING APPARATUS AND INK CONTAINER

(71) Applicant: KYOCERA Document Solutions Inc., Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/928,158

(22) Filed: Jun. 26, 2013

(65) Prior Publication Data

US 2014/0002553 A1 Jan. 2, 2014

(30) Foreign Application Priority Data

Jun. 29, 2012 (JP) ..... 2012-146678
Sep. 28, 2012 (JP) ..... 2012-215668

(51) Int. Cl.
*B41J 29/393* (2006.01)
*B41J 2/175* (2006.01)
*G08B 13/14* (2006.01)

(52) U.S. Cl.
CPC ..... *B41J 2/17503* (2013.01); *B41J 2/17553* (2013.01); *B41J 2/1752* (2013.01); *B41J 2/17513* (2013.01)
USPC ..... 347/19; 347/86; 340/572.1

(58) Field of Classification Search
USPC ..... 347/19, 85, 86, 87; 73/290 R; 116/227; 324/667; 340/572.1, 612, 618; 399/12
See application file for complete search history.

(56) References Cited

U.S. PATENT DOCUMENTS

| | | | | |
|---|---|---|---|---|
| 7,048,366 | B2 * | 5/2006 | Alexia et al. | 347/87 |
| 7,107,836 | B2 * | 9/2006 | Brookner | 73/290 R |
| 7,422,316 | B2 * | 9/2008 | Shinada | 347/86 |
| 7,756,427 | B2 * | 7/2010 | Hanano et al. | 399/12 |
| 7,841,686 | B2 * | 11/2010 | Kyoshima | 347/19 |
| 7,982,623 | B2 * | 7/2011 | Higashionji et al. | 340/612 |
| 2006/0017755 | A1 | 1/2006 | Shinada | |
| 2008/0166138 | A1 | 7/2008 | Hanano et al. | |
| 2014/0036008 | A1 * | 2/2014 | Maeshima | 347/86 |

FOREIGN PATENT DOCUMENTS

| | | | |
|---|---|---|---|
| CN | 1727188 | A | 2/2006 |
| CN | 101221407 | A | 7/2008 |
| JP | 2003-167515 | A | 6/2003 |
| JP | 2010-012659 | A | 1/2010 |

OTHER PUBLICATIONS

The first Office Action issued by the Chinese Patent Office on Oct. 24, 2014, which corresponds to Chinese Patent Application No. 201310250100.5 and is related to U.S. Appl. No. 13/928,158.

* cited by examiner

*Primary Examiner* — Anh T. N. Vo
(74) *Attorney, Agent, or Firm* — Studebaker & Brackett PC

(57) ABSTRACT

An inkjet image forming apparatus includes an ink container and a container installed part. The ink container stores an ink. To the container installed part, the ink container is attached/detached. The ink container includes an RFID tag, a pouch pack and a container case. The pouch pack contains the ink. The container case covers the pouch pack, has one wall to which the RFID tag is fixed and further has an engaging part stopping the pouch pack in an engaged state and keeping a distance between the RFID tag and the pouch pack a predetermined value or more. The container installed part includes an RFID sensing circuit board configured to carry out wireless communication with the RFID tag.

20 Claims, 6 Drawing Sheets

INKJET IMAGE FORMING APPARATUS AND INK CONTAINER

INCORPORATION BY REFERENCE

This application is based on and claims the benefit of priority from Japanese Patent application No. 2012-146678 filed on Jun. 29, 2012 and Japanese Patent application No. 2012-215668 filed on Sep. 28, 2012, the entire contents of which are incorporated herein by reference.

BACKGROUND

The present disclosure relates to an inkjet image forming apparatus and an ink container storing an ink used in this inkjet image forming apparatus.

An inkjet image forming apparatus forms an image on a sheet surface by discharging an ink from a recording head to a sheet. The ink discharged from the recording head to the sheet is supplied from an ink container to the recording head. The ink container includes, for example, a pouch pack containing the ink and a container case housing the pouch pack. The pouch pack is formed, for instance, by flexible film material. This film material may include an electric conductive layer made by aluminum or other electric conductive material with intent to improve gas barrier property.

In addition, the inkjet image forming apparatus may manage the ink container by a contact type sensing means or manage the ink container by RFID (Radio Frequency Identification) as a non-contact type sensing means. Concretely, between an RFID tag stuck on the container case of the ink container and an RFID sensing circuit board attached to a container installed part to which the ink container is attached/detached, wireless communication is carried out. Then, ink container information stored in the RFID tag is read out by the RFID sensing circuit board and used for managing the ink container.

SUMMARY

In accordance with an embodiment of the present disclosure, an inkjet image forming apparatus includes an ink container and a container installed part. The ink container stores an ink. To the container installed part, the ink container is attached/detached. The ink container includes an RFID tag, a pouch pack and a container case. The pouch pack contains the ink. The container case covers the pouch pack, has one wall to which the RFID tag is fixed and further has an engaging part stopping the pouch pack in an engaged state and keeping a distance between the RFID tag and the pouch pack a predetermined value or more. The container installed part includes an RFID sensing circuit board configured to carry out wireless communication with the RFID tag.

Furthermore, in accordance with an embodiment of the present disclosure, an ink container is attached/detached to a container installed part of an inkjet image forming apparatus to store an ink. The ink container includes an RFID tag, a pouch pack and a container case. The RFID tag carries out wireless communication with an RFID sensing circuit board of the container installed part. The pouch pack contains the ink. The container case covers the pouch pack, has one wall to which the RFID tag is fixed and further has an engaging part stopping the pouch pack in an engaged state and keeping a distance between the RFID tag and the pouch pack a predetermined value or more.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
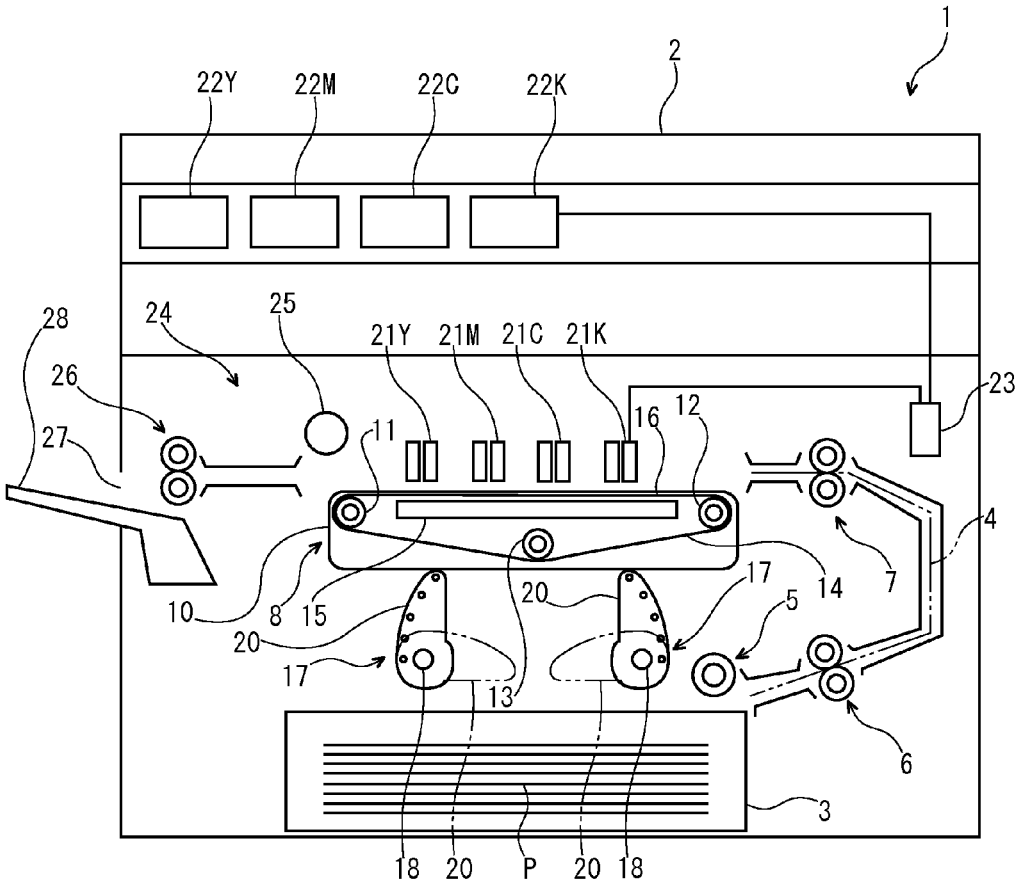
FIG. 1 is a schematic diagram schematically showing a printer according to an embodiment of the present disclosure.

First, with reference to FIG. 1, the entire structure of an inkjet color printer (an inkjet image forming apparatus) 1 will be described. Hereinafter, the inkjet color printer 1 is called as a "printer 1". Hereinafter, it will be described so that the front side of the printer 1 is positioned at this side (a reader's side) of FIG. 1.

The printer 1 includes a box-formed printer main body 2 (apparatus main body). To a lower part of the printer main body 2, a sheet feeding cartridge 3 configured to store sheets P is installed.

In a right part of the printer main body 2, a conveying path 4 for the sheet P is arranged. Ata lower end of the conveying path 4, a sheet feeding roller 5 is positioned near the sheet feeding cartridge 3 and, at the right side of the sheet feeding roller 5, conveying rollers 6 are positioned. At an upper end of the conveying path 4, resist rollers 7 are positioned.

In an intermediate part of the printer main body 2, an upward/downward movable conveying unit 8 is attached. The conveying unit 8 includes a conveyance frame 10, a driving roller 11, a follower roller 12, a tension roller 13, an endless conveyance belt 14 and an air intake duct 15. The driving roller 11 is rotatably supported at a left upper corner of the conveyance frame 10. The follower roller 12 is rotatably supported at a right upper corner of the conveyance frame 10. The tension roller 13 is rotatably supported at a middle lower part of the conveyance frame 10. The conveyance belt 14 is wound around the driving roller 11, follower roller 12 and tension roller 13. The air intake duct 15 is located so as to be surrounded by the conveyance belt 14.

An upper face of the conveyance belt 14 is a roughly flat conveyance face 16. The conveyance belt 14 has a lot of air intake holes (not shown) and a top face of the air intake duct 15 also has a lot of air intake holes (not shown). The air intake duct 15 is connected with a suction device (not shown), such as a suction pomp. Accordingly, by activating the suction device, an air can be sucked via the air intake holes of the conveyance belt 14 and the air intake holes of the air intake duct 15 from the conveyance face 16 side in the conveyance belt 14 to the air intake duct 15 side.

In an intermediate lower part of the printer main body 2, a pair of left and right elevating devices 17 is attached below the conveying unit 8. Each elevating device 17 includes a rotation axis 18 and a cam 20 supported by the rotation axis 18. The cam 20 is connected with a driving device (not shown), such as a driving motor. Accordingly, by activating the driving device, each cam 20 rotates around the rotation axis 18 so that a posture of the cam 20 is switched between an upright posture (refer to solid line in FIG. 1) and a laid-down posture (refer to two-dot chain line in FIG. 1). The cam 20 is switched to the upright posture to lift up the conveyance frame 10 and to move the conveying unit 8 upward or switched to the laid-down posture to release the lift of the conveyance frame 10 and to move the conveying unit 8 downward.

In the intermediate part of the printer main body 2, four recording heads 21 (21K, 21C, 21M, 21Y) are arranged in parallel. The recording heads 21 correspond to black (K), cyan (C), magenta (M) and yellow (Y) from an upper stream side (a right side in the embodiment) in order of a conveying direction of the sheet P. Hereinafter, except for the description to be specified by the colors, the reference characters "Y", "C", "M" and "K" with regard to the recording heads 21 are omitted. The recording heads 21 are provided with respective nozzles (not shown) facing to the conveyance face 16 of the conveyance belt 14.

In the upper part of the printer main body 2, four ink containers 22 (22K, 22C, 22M, 22Y) are installed in parallel. The four ink containers 22 are provided for each ink color to store respective inks of black (K), cyan (C), magenta (M) and yellow (Y) from an upper stream side (a right side in the embodiment) in order of the conveying direction of the sheet P. Hereinafter, except for the description to be specified by the colors, the reference characters "Y", "C", "M" and "K" with regard to the ink containers 22 are omitted. In the figures, the reference characters "Y", "C", "M" and "K" with regard to the ink containers 22 are often omitted.

Each ink container 22 is connected with each recording head 21 via a sub container 23 so that the ink stored in the ink container 22 is temporarily retained in the sub container 23 and then supplied to the recording head 21. The sub container 23 is provided corresponding to each color of black (K), cyan (C), magenta (M) and yellow (Y) similar to the recording heads 21 and ink containers 22. In FIG. 1, the sub container 23 corresponding to black (K) is illustrated and the other sub containers 23 corresponding to the other colors are omitted.

In a left part of the printer main body 2, an ejecting mechanism 24 is arranged. The ejecting mechanism 24 includes a drying device 25, ejecting rollers 26 and a sheet ejecting tray 28. The drying device 25 is located at the left upper side of the conveying unit 8. The ejecting rollers 26 are located at the left side of the drying device 25. The sheet ejecting tray 28 is located below the ejecting rollers 26 and protruded outside of the printer main body 2 via an ejecting port 27.

Next, the operation of forming an image by the printer 1 having such a configuration will be described.

In the printer 1, when image data is received from an external computer or the like, the sheet P stored in the sheet feeding cartridge 3 is fed to the conveying path 4 by the sheet feeding roller 5. The sheet P fed to the conveying path 4 is conveyed to a lower stream side of the conveying path 4 by the conveying rollers 6 and fed from the conveying path 4 to the conveyance face 16 of the conveyance belt 14 by the resist rollers 7.

The sheet P fed to the conveyance face 16 of the conveyance belt 14 is absorbed to the conveyance face 16 of the conveyance belt 14 by suction force of the suction device (not shown) connected with the air intake duct 15. To the sheet P absorbed to the conveyance face 16, each recording head 21 discharges the ink on the basis of the information of the image data received from the external computer or the like. Thereby, a color ink image is formed on the sheet P. The sheet P having the color ink image is advanced so that the ink on the surface is dried by the drying device 25, and then, ejected on the sheet ejecting tray 28 by the ejecting rollers 26.

Next, the upper part of the printer main body 2 will be described in detail. Arrows Fr shown in FIG. 2 and following figures indicate the front side of the printer 1.

Figure 2:
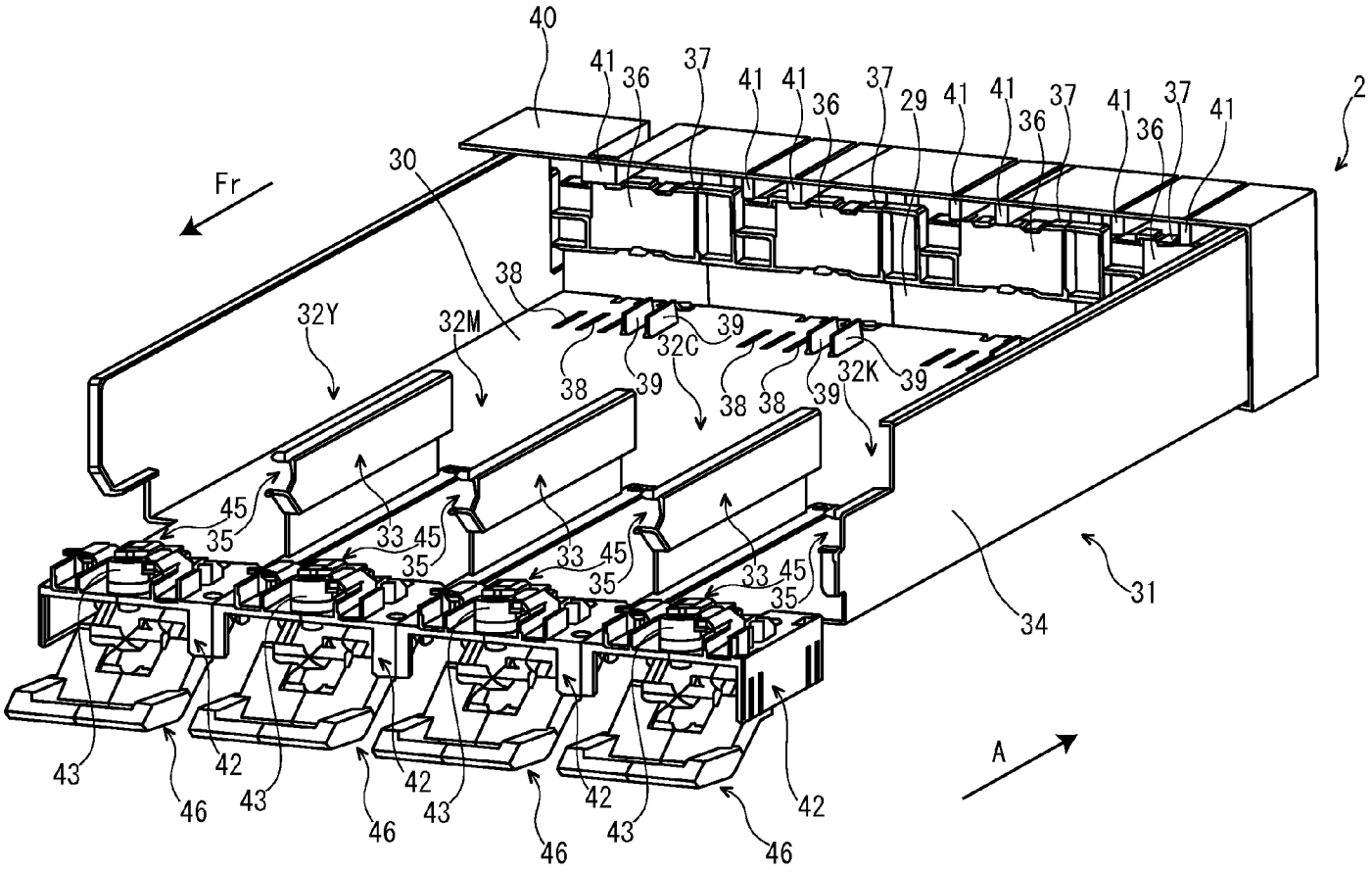
FIG. 2 is a perspective view showing the printer in a situation, in which ink containers are detached from respective container installed parts, according to the embodiment of the present disclosure.
Figure 3:
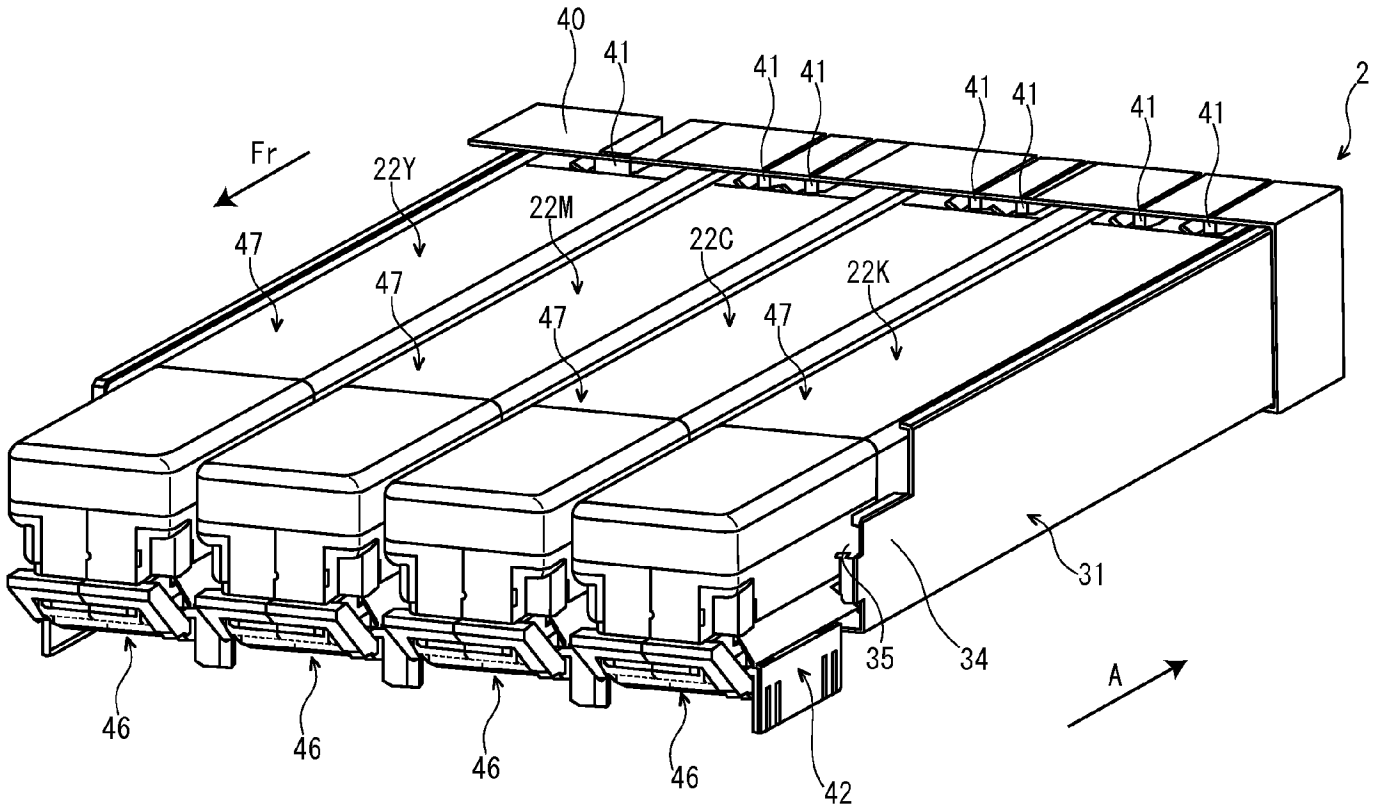
FIG. 3 is a perspective view showing the printer in a situation, in which the ink containers are attached to the respective container installed parts, according to the embodiment of the present disclosure.

As shown in FIG. 2, in the upper part of the printer main body 2, an installation frame 31 having opened top face and front face is provided. In the installation frame 31, four container installed parts 32 (32K, 32C, 32M, 32Y) extending in forward and backward directions or a depth direction are arranged for every ink colors. To the container installed parts 32, the ink containers 22 of black (K), cyan (C), magenta (M) and yellow (Y) are arranged from the right so as to suitably be attached/detached along the forward/backward directions (refer to FIG. 3). In the embodiment, the front side of the printer 1 is front side (a user's side) in an installing direction of the ink container 22 to the container installed part 32 and the rear side of the printer 1 is a rear side in the installing direction of the ink container 22 to the container installed part 32. Arrows A shown in FIG. 2 and following figures indicate the installing direction of the ink container 22 to the container installed part 32. Hereinafter, except for the description to be specified by the colors, the reference characters "Y", "C", "M" and "K" with regard to the container installed parts 32 are omitted. In the figures, the reference characters "Y", "C", "M" and "K" with regard to the container installed parts 32 are often omitted.

As shown in FIG. 2, in a front part of the installation frame 31, three partition boards 33 extending in the forward/backward directions are stood at intervals in left and right directions or a horizontal direction so that the container installed parts 32 are partitioned by the partition boards 33. In the partition boards 33 and a right wall 34 of the installation frame 31, guide grooves 35 are formed.

To a rear face 29 of the installation frame 31, RFID sensing circuit boards 36 are respectively attached by holders 37 at positions corresponding to the container installed parts 32. In a rear part of a lower face 30 (a face adjacent to the rear face 29 of the installation frame 31) of the installation frame 31, five slit-liked fixing holes 38 are bored or formed at a position corresponding to each container installed part 32. For example, to right two of the five fixing holes 38, fixed boards 39 are fixed. The fixed board 39 is protruded from the lower face 30. The fixed boards 39 may be selected according to a specification of the printer main body 2 to be fixed to one or more of the five fixing holes 38. For example, with regard to another printer main body having a different specification from the printer main body 2 of the embodiment, left two of the five fixing holes 38 or other different combination of the fixing holes 38 from the embodiment may be selected for fixing the fixed boards 39. The above-mentioned specification of the printer main body 2 is specified for each kind of the printer 1, for example, according to print quality, print speed, a purpose and other elements.

On a rear end of the installation frame 31, an upper frame 40 extending in the left/right directions is attached. On a bottom face (a face adjacent to the rear face 29 of the installation frame 31) of the upper frame 40, protrusions 41 are respectively formed at positions corresponding to the container installed parts 32. Among the container installed parts 32, the arrangement in the left/right directions of the protrusions 41 are differed from each other.

Figure 4:
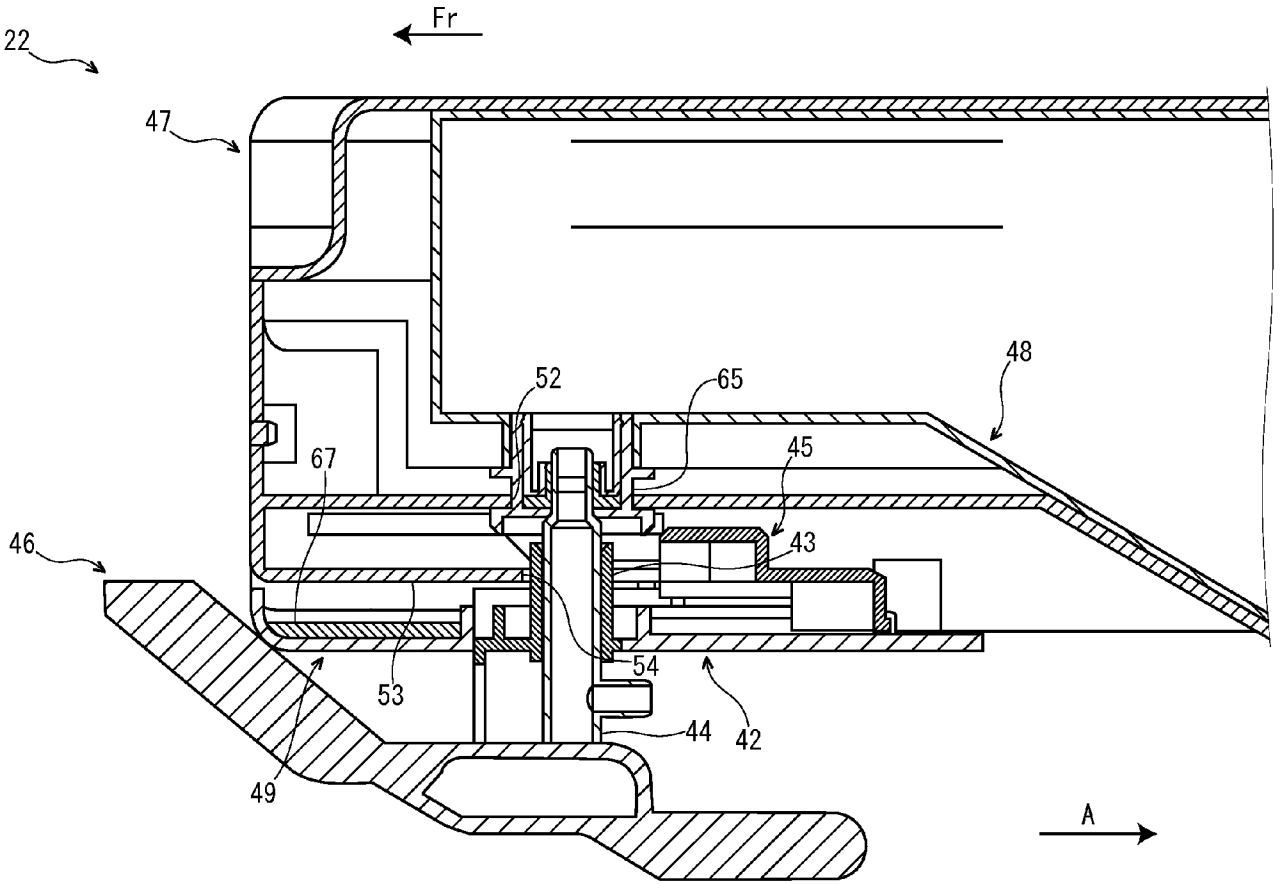
FIG. 4 is a sectional view showing a front part and the circumference of the ink container in the printer according to the embodiment of the present disclosure.

In front of the installation frame 31, container installing guides 42 are respectively provided at positions as front ends of the container installed parts 32. In centers of front parts of the container installing guides 42, cylinder-liked guide pipes 43 are respectively attached. As shown in FIG. 4, inside each guide pipe 43, a needle 44 is installed in an upward/downward movable state. The needle 44 is connected with the sub container 23 (refer to FIG. 1).

In upper faces of the container installing guides 42, main body side shutters 45 are respectively attached. The main body side shutter 45 can move in the forward/backward directions between a position covering the needle 44 and another position exposing the needle 44. FIG. 4 shows a condition of the main body side shutter 45 at the other position exposing the needle 44.

Below the container installing guides 42, levers 46 are respectively attached. Each lever 46 is supported by the container installing guide 42 to be able to swing in upward and downward directions. The lever 46 is located below the needle 44.

Next, the ink container 22 will be described in detail.

As shown in FIG. 4, each ink container 22 includes a box-formed container case 47, a pouch pack 48 housed in the container case 47 and a container side shutter 49 installed to a front lower end of the container case 47.

Figure 5:
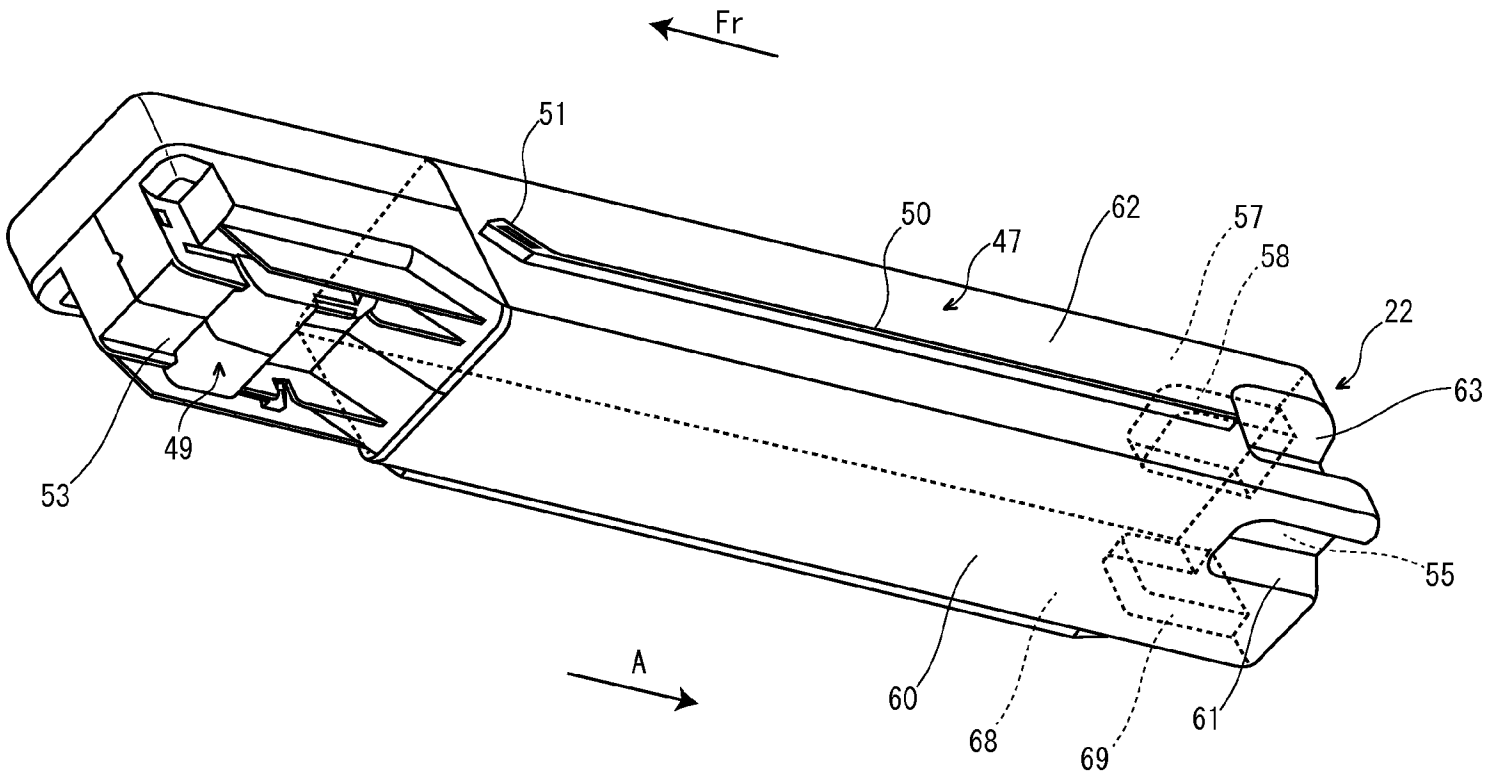
FIG. 5 is a perspective view showing the ink container in the printer according to the embodiment of the present disclosure.

First, the container case 47 will be described. As shown in FIG. 5, the container case 47 is formed in an extended shape in the forward/backward directions. The container case 47 has a capacity of housing the pouch pack 48. On the container case 47, a guide rib 50 extending in the forward/backward directions is protruded so that the guide rib 50 can be inserted in the guide groove 35 (refer to FIG. 2) of the container installed part 32. In a front end of the guide rib 50, an inclined part 51 inclining forward and upward is formed.

As shown in FIG. 4, in a front end of a bottom face of the container case 47, a spout inserting hole 52 is bored in the upward/downward directions. In the front end of the container case 47, a bottom end board 53 is provided and, in a rear end of the bottom end board 53, a notch 54 is formed.

Figure 6:
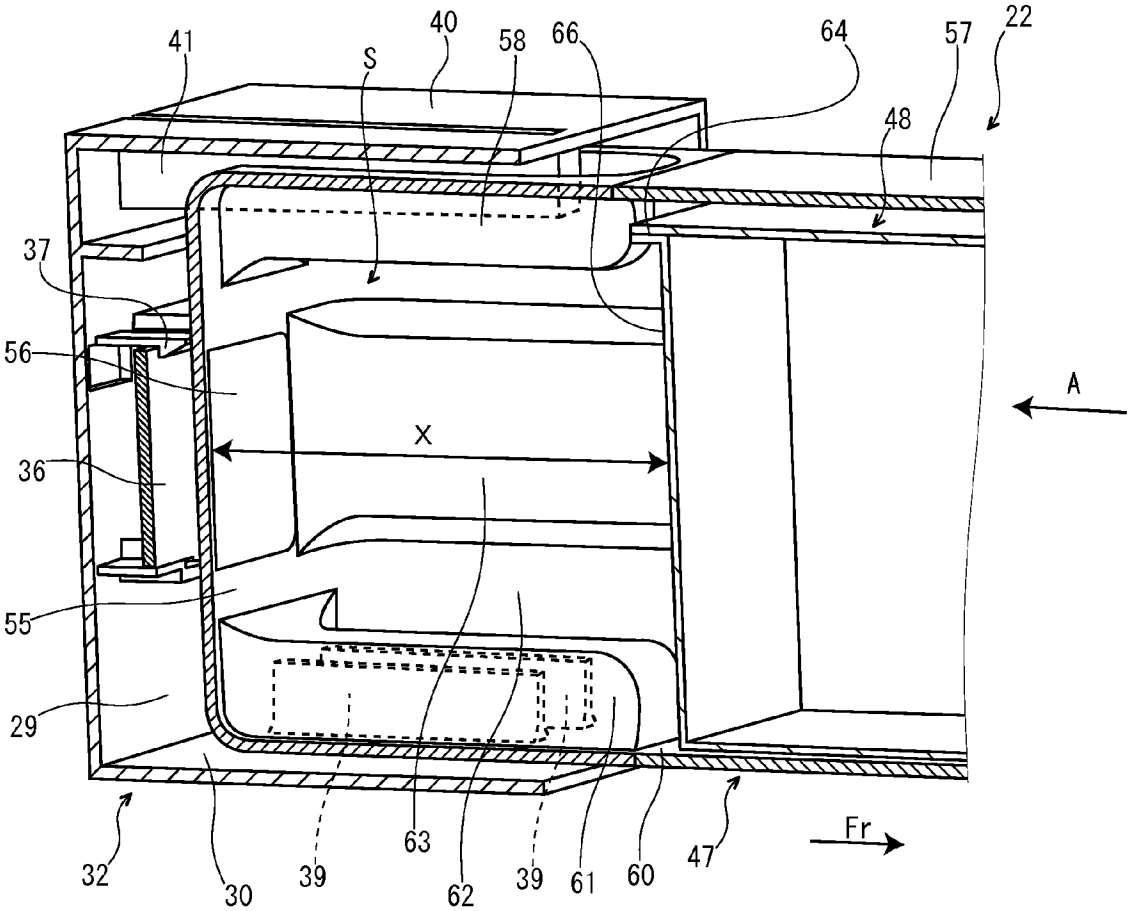
FIG. 6 is a perspective sectional view showing a rear part and the circumference of the ink container in the printer according to the embodiment of the present disclosure.

A length in the forward/backward directions of the container case 47 is designed sufficiently longer than a length in the forward/backward directions of the pouch pack 48. Accordingly, as shown in FIG. 6, inside the container case 47, a space S is arranged behind of the pouch pack 48.

To a center in the upward/downward directions on a rear wall 55 (a wall at the rear side in the installing direction of the ink container 22) as one wall of the container case 47, an RFID tag 56 is fixed. Then, the ink container 22 and container installed part 32 are configured that, in a condition of having the ink container 22 installed to the container installed part 32, the RFID tag 56 faces to the RFID sensing circuit board of the container installed part 32 and a wireless communication is carried out between the RFID sensing circuit board 36 and RFID tag 56.

The RFID tag 56 includes a non-volatile memory and the memory stores information regarding the ink container 22, for example, the model number, the date of manufacture, the serial number, the usage history, the ink color and other information. The embodiment is configured that these information are read out by the RFID sensing circuit board 36 and outputted to a controller (not shown), and then, the controller carries out various decisions on the basis of the information. The above-mentioned various decisions have, for example, a decision whether or not the ink container 22 is a genuine product and another decision whether or not the ink container 22 is an unused product. Thus, in the embodiment, the RFID is used as a sensing device for managing the ink container 22.

In the container case 47, an upper engaging part 58 is provided to extend from an upper wall 57 (a wall adjacent to the rear wall 55) to the rear wall 55. The upper engaging part 58 is formed by hollowing the upper wall 57 toward an internal side (a lower side) of the container case 47. In another view, the upper engaging part 58 is protruded from the upper wall 57 to the space S in the container case 47. The upper engaging part 58 is provided by hollowing at a different position in the left/right directions from other ink containers 22.

In the container case 47, a lower engaging part 61 is provided to extend from a lower wall 60 (another wall adjacent to the rear wall 55) to the rear wall 55. The lower engaging part 61 is formed by hollowing the lower wall 60 toward the internal side (an upper side) of the container case 47. In another view, the lower engaging part 61 is protruded from the lower wall 60 to the space S in the container case 47. The lower engaging part 61 is provided by hollowing at a position in the left/right directions differed among ink container corresponding to printer main bodies that have different specifications from each other. That is, in another ink container to be installed to another printer main body having different specification from the printer main body 2 of the embodiment, a hollowing position in the left/right directions of the lower engaging part differs from the embodiment.

In the container case 47, a right engaging part 63 is provided to extend from a right wall 62 (further wall adjacent to the rear wall 55) to the rear wall 55. The right engaging part 63 is formed by hollowing the right wall 62 toward the internal side (a left side) of the container case 47. In another view, the right engaging part 63 is protruded from the right wall 62 to the space S in the container case 47.

As shown in FIG. 5, in a left wall 68 (still another wall adjacent to the rear wall 55) in the container case 47, a left engaging part 69 is provided. The left engaging part 69 is configured in similar to the right engaging part 63, and therefore, the description of the configuration is omitted. The right engaging part 63 and left engaging part 69 are located at common positions in the container case 47 of each ink container 22 regardless color and specification of the ink container 22.

Next, the pouch pack 48 will be described. The pouch pack 48 is formed like a bag. In the pouch pack 48, the ink is contained in a vacuum. The pouch pack 48 is made of pliability (flexible) film material. This film material is formed by laminating resin and aluminum. As an example, from a top surface in order, polyester (PET), aluminum (AL), nylon (PA) and low level density polyethylene (LLDPE) are laminated. Because the top surface is made of polyester, the external appearance and the strength of the pouch pack 48 can be increased. Because an aluminum layer is made, gas barrier property of the pouch pack 48 can be increased to heighten storage stability of the ink. That is, in the embodiment, aluminum is used as a barrier material. A nylon layer enables impact resistance and mechanical strength of the pouch pack 48 to be increased. Because a back surface is made of low level density polyethylene, it is possible to heighten welding strength of a welding part 64 (refer to FIG. 6) when the film material is shaped like a bag by welding, and then, to increase sealing quality.

As shown in FIG. 4, in a front end of the pouch pack 48, a cylinder-liked spout 65 is welded so that the ink contained in the pouch pack 48 can be ejected via the spout 65. The spout 65 is inserted in the spout inserting hole 52 of the container case 47. Accordingly, the pouch pack 48 is fixed in the container case 47 so that the spout 65 is pointed downward. In the spout 65, the needle 44 is attachably/detachably inserted, thereby supplying the ink contained in the pouch pack 48 to the sub container 23 (refer to FIG. 1) via the spout 65 and needle 44.

As shown in FIG. 6, a back end 66 (an end at the rear side in the installing direction of the ink container 22) of the pouch pack 48 is stopped in an engaged state by the upper engaging part 58, lower engaging part 61, right engaging part 63 and left engaging part 69 of the container case 47.

Next, the container side shutter 49 will be described. As shown in FIG. 4, the container side shutter 49 is located below the spout 65 to leave a space from the spout 65. The container side shutter 49 is supported by the container case 47 in a forward/backward movable state, thereby being capable of switching between a closing state covering a bottom of the spout 65 and an opening state exposing the spout 65. FIG. 4 shows a condition of the container side shutter 49 being in the opening state. To an upper face of the container side shutter 49, a liquid absorbing member 67 is attached. The liquid absorbing member 67 is located to leave a space from the spout 65.

In the ink container 22 configured as mentioned above, because the pouch pack 48 is flexible, the shape of the pouch pack 48 is deformed according to remaining quantity of the ink. Concretely, as the ink is used to decrease the quantity of the ink in the pouch pack 48, the pouch pack 48 is thinned. According to this, if the pouch pack 48 extended to a side of the space S (refer to FIG. 6), a distance X in the forward/backward directions between the RFID tag 56 and the back end 66 of the pouch pack 48 would be shortened.

When the RFID is used for managing the ink container 22 including the pouch pack 48 with the film material having the electric conductive layer, if the RFID tag 56 and back end 66 of the pouch pack 48 were too close, the electric conductive layer of the film material of the pouch pack 48 may hinder the wireless communication between the RFID tag 56 and RFID sensing circuit board 36. In such a case, the RFID sensing circuit board 36 may not read out the information stored in the RFID tag 56.

However, in the embodiment, as mentioned above, the upper engaging part 58, lower engaging part 61, right engaging part 63 and left engaging part 69 (hereinafter, called as "respective engaging parts") stop the back end 66 (the end at the rear side in the installing direction) of the pouch pack 48 in an engaged state. Accordingly, it is possible to keeping a distance X in the forward/backward directions between the RFID tag 56 and the back end 66 of the pouch pack 48 a predetermined value or more. Therefore, if the film material of the pouch pack 48 contains the electric conductive layer (the aluminum layer in the embodiment), it is possible to surely work the RFID.

On the other hand, in order to sufficiently separate the RFID tag 56 and back end 66 of the pouch pack 48, if a simple space were put between a sticking part of the RFID tag 56 and a covering part of the pouch pack 48 in the container case 47, the pouch pack 48 may become easily vibrated inside the container case 47 by impact or the like during transportation. In such a case, it is feared that a load of weight or the like of the ink concentrates on a fixing part of the pouch pack 48 and container case 47, and then, damage of the pouch pack 48 is occurred.

However, in the embodiment, because the respective engaging parts stop the back end 66 of the pouch pack 48 in an engaged state, it is possible to restrain vibration of the pouch pack 48 in the container case 47 caused by impact or the like during transportation. According to this, load to the pouch pack 48 is decreased, thereby preventing damage of a fixing part (e.g. a periphery part of the spout 65) of the pouch pack 48 to the container case 47. By restraining the vibration of the pouch pack 48 as mentioned above, it is also possible to decrease the load of not only the pouch pack 48 but also the container case 47.

Moreover, in particular in the embodiment, because the respective engaging parts are hollowed toward the internal side of the container case 47, redundant protrusion is not formed outside the container case 47, thereby smoothly attaching and detaching the ink container 22 to and from the container installed part 32. It is also possible to easily shape the respective engaging parts by blow molding.

Furthermore, in the printer 1 configured as mentioned above, in a case where the ink container 22 is installed to the container installed part 32 being consistent in the ink color (e.g. a case where the ink container 22K is installed to the container installed part 32K), as shown in FIG. 6, the protrusions 41 engage with the upper engaging part 58. By contrast, in another case where the ink container 22 is installed to the container installed part 32 not being consistent in the ink color (e.g. a case where the ink container 22C is installed to the container installed part 32K), the positions in the left/right directions of the protrusions 41 and upper engaging part 58 do not match with each other, and then, the protrusions 41 interfere with the rear wall 55 of the container case 47. By such a configuration, it is possible to prevent the ink container 22 from being installed in mistake to the container installed part 32 not being consistent in the ink color.

In addition, in a case where the ink container 22 being consistent in the specification of the printer main body 2 is installed to the container installed part 32, as shown in FIG. 6, the positions in the left/right directions of the fixed board 39 and lower engaging part 61 match with each other, and then, the fixed board 39 engages with the lower engaging part 61. By contrast, in another case where the ink container not being consistent in the specification of the printer main body 2 is installed to the container installed part 32, the positions in the left/right directions of the fixed board 39 and lower engaging part do not match with each other, and then, the fixed board 39 interferes with the rear wall of the container case. By such a configuration, it is possible to prompt a user to install the ink container 22 being consistent in the specification of the printer main body 2 to the container installed part 32. Therefore, it is possible to carry out the image forming operation by suitable ink on the basis of the print quality, print speed, a purpose and other elements of the printer main body 2.

As mentioned above, in accordance with the embodiment, by utilizing the upper engaging part 58 and lower engaging part 61, it is possible to prevent the ink container 22 from being installed in mistake to the container installed part 32 not being consistent in the ink color and to prompt the user to install the ink container 22 with the genuine specification to the container installed part 32.

In addition, in accordance with the embodiment, because the ink container 22 has a space-saving and simple form, it is possible to minimize the ink container 22 itself and to sufficiently secure the quantity of the pouch pack 48.

Moreover, in accordance with the embodiment, the RFID tag 56 is fixed to the rear wall 55 as the wall at the rear side of the container case 47 in the installing direction and the respective engaging parts stop the back end 66 as the end at the rear side of the pouch pack 48 in the installing direction in an engaged state. By applying such a configuration, it is possible to keep a distance X in the installing direction between the RFID tag 56 and pouch pack 48 a predetermined value or more by the respective engaging parts. It is also possible to restrain vibration of the pouch pack 48 in the installing direction in the container case 47 caused by impact or the like during transportation.

In the embodiment, the protrusion 41 is used to prevent the ink container 22 from installing in mistake to the container installed part 32 not being consistent in the ink color. On the other hand, another embodiment may be configured that the fixed boards 39 are used to prevent the ink container 22 from installing in mistake to the container installed part 32 not being consistent in the ink color. In this case, the combination of the fixing holes 38 fixing the fixed boards 39 may be varied according to the ink color type of each container installed part 32 and the hollowing position of the lower engaging part 61 may be varied according to the ink color type of each ink container 22. Accordingly, the ink container 22 and container installed part 32 may be configured that, when the ink container 22 is installed to the container installed part 32 being consistent in the ink color, the fixed board 39 engages with the lower engaging part 61.

In the embodiment, the fixed boards 39 is used to prompt the user to install the ink container 22 being consistent in the specification of the printer main body 2 to the container installed part 32. On the other hand, a further embodiment may be configured that the protrusion 41 is used to prompt the user to install the ink container 22 being consistent in the specification of the printer main body 2 to the container installed part 32. In this case, the position of the protrusion 41 may be varied according to the specification of each printer main body 2 and the hollowing position of the upper engaging part 58 may be varied according to the ink container 22 being consistent in the specification of each printer main body 2. Accordingly, the ink container 22 and container installed part 32 may be configured that, when the ink container 22 being consistent in the specification of the printer main body 2 is installed to the container installed part 32 being consistent in the ink color, the protrusions 41 engages with the upper engaging part 58. Alternatively, in a furthermore embodiment, the fixed boards 39 and/or protrusion 41 may be used to prompt the user to install the ink container 22 to the container installed part 32 of a genuine destination.

As the embodiment, printer 1 in which the respective engaging parts are provided on all the walls adjacent to the rear wall 55 of the container case 47 was described. However, still another embodiment may be configured that the respective engaging parts are provided on a part of the walls adjacent to the rear wall 55 of the container case 47.

In the embodiment, the respective engaging parts are formed by hollowing the upper wall 57, lower wall 60, right wall 62 and left wall 68 (hereinafter, called as "respective walls") toward the internal side of the container case 47. That is, by the respective engaging parts, on the respective walls, depressions to the internal side are formed. On the other hand, a still further embodiment may be configured that the respective walls of the container case 47 are formed flat and other rib-liked engaging parts are protruded from the respective walls to the internal side of the container case 47.

As the embodiment, printer 1 in which the RFID tag 56 is fixed to the rear wall 55 as the wall at the rear side of the container case 47 in the installing direction was described. On the other hand, a still furthermore embodiment may be configured that, for example, the RFID tag 56 is fixed to a front wall (a wall at front side in the installing direction) or the upper wall 57, lower wall 60, right wall 62 or left wall 68.

As the embodiment, printer 1 in which the respective engaging parts stop the back end 66 as the end at the rear side of the pouch pack 48 in the installing direction in an engaged state was described. On the other hand, another embodiment may be configured that the respective engaging parts stop the front end (an end at front side in the installing direction), upper and lower parts or left and right parts in the pouch pack 48.

Although as the embodiment, configurations of the disclosure are applied to the printer 1 as the inkjet image forming apparatus, as a further embodiment, the ideas of the disclosure may be applied to another inkjet image forming apparatus, such as a copying machine, a facsimile or a multifunction machine.

What is claimed is:

1. An inkjet image forming apparatus comprising:

an ink container configured to store an ink; and a container installed part to which the ink container is attached/detached along an installing direction, wherein the ink container includes an RFID tag, a pouch pack configured to contain the ink and a container case configured to cover the pouch pack, to have one wall, to which the RFID tag is fixed, at a rear side in the installing direction and to further have an engaging part stopping the pouch pack in an engaged state and keeping a distance between the RFID tag and the pouch pack a predetermined value or more, and the container installed part includes an RFID sensing circuit board configured to carry out wireless communication with the RFID tag.

2. The inkjet image forming apparatus according to claim 1, comprising a plurality of the ink containers and a plurality of the container installed parts respectively corresponding to ink colors, wherein each of the container installed part further includes a protrusion on a face adjacent to another face on which the RFID sensing circuit board is provided at a different position from other container installed parts, the engaging part of each ink container is provided by hollowing a wall adjacent to the one wall toward the internal side of the container case at a different position from other ink containers, and when the ink container is installed to the container installed part being consistent in the ink color, the protrusion engages with the engaging part.

3. The inkjet image forming apparatus according to claim 1, wherein the container installed part is provided in an apparatus main body, the container installed part further includes a plurality of fixing holes formed in a face adjacent to another face on which the RFID sensing circuit board is provided, a fixed board fixed to one or more of the fixing holes selected according to a specification of the apparatus main body and protruded from the face adjacent to the other face on which the RFID sensing circuit board is provided, the engaging part of the ink container is provided by hollowing a wall adjacent to the one wall toward the internal side of the container case at a position according to the specification of the apparatus main body, when the ink container being consistent in the specification of the apparatus main body is installed to the container installed part, the fixed board engages with the engaging part.

4. The inkjet image forming apparatus according to claim 1, wherein the container installed part is provided in an apparatus main body, the container installed part further includes a protrusion on a face adjacent to another face on which the RFID sensing circuit board is provided at a position according to a specification of the apparatus main body, the engaging part of each ink container is provided by hollowing a wall adjacent to the one wall toward the internal side of the container case at a position according to the specification of the apparatus main body, and when the ink container being consistent in the specification of the apparatus main body is installed to the container installed part, the protrusion engages with the engaging part.

5. The inkjet image forming apparatus according to claim 1, comprising a plurality of the ink containers and a plurality of the container installed parts respectively corresponding to ink colors, wherein the container installed part further includes a plurality of fixing holes bored in a face adjacent to another face on which the RFID sensing circuit board is provided, and a fixed board fixed to one or more of the fixing holes selected according to the container installed part and protruded from the face adjacent to the other face on which the RFID sensing circuit board is provided, the engaging part of the each ink container is provided by hollowing a wall adjacent to the one wall toward the internal side of the container case at a different position from other ink containers, when the ink container is installed to the container installed part being consistent in the ink color, the fixed board engages with the engaging part.

6. The inkjet image forming apparatus according to claim 1, wherein the pouch pack is made of a film material formed by laminating resin and aluminum.

7. The inkjet image forming apparatus according to claim 1, wherein the engaging part is configured to stop an end at the rear side of the pouch pack in the installing direction in an engaged state.

8. The inkjet image forming apparatus according to claim 1, wherein the engaging part is provided to extend to the one wall from a wall adjacent to the one wall.

9. The inkjet image forming apparatus according to claim 1, wherein the engaging part is provided on all of a plurality of walls adjacent to the one wall of the container case.

10. The inkjet image forming apparatus according to claim 1, wherein the engaging part is provided on a part of a plurality of walls adjacent to the one wall of the container case.

11. An ink container being attached/detached to a container installed part of an inkjet image forming apparatus along an installing direction to store an ink, comprising:

an RFID tag configured to carry out wireless communication with an RFID sensing circuit board of the container installed part, a pouch pack configured to contain the ink and a container case configured to cover the pouch pack, to have one wall, to which the RFID tag is fixed, at a rear side in the installing direction and to further have an engaging part stopping the pouch pack in an engaged state and keeping a distance between the RFID tag and the pouch pack a predetermined value or more.

12. The ink container according to claim 11, wherein a plurality of the ink containers and a plurality of the container installed parts respectively corresponding to ink colors, wherein each of the container installed part further includes a protrusion on a face adjacent to another face on which the RFID sensing circuit board is provided at a different position from other container installed parts, the engaging part of each ink container is provided by hollowing a wall adjacent to the one wall toward the internal side of the container case at a different position from other ink containers, and when the ink container is installed to the container installed part being consistent in the ink color, the protrusion engages with the engaging part.

13. The ink container according to claim 11, wherein the container installed part is provided in an apparatus main body, the container installed part further includes a plurality of fixing holes formed in a face adjacent to another face on which the RFID sensing circuit board is provided, and a fixed board fixed to one or more of the fixing holes selected according to a specification of the apparatus main body and protruded from the face adjacent to the other face on which the RFID sensing circuit board is provided, the engaging part of the ink container is provided by hollowing a wall adjacent to the one wall toward the internal side of the container case at a position according to the specification of the apparatus main body, when the ink container being consistent in the specification of the apparatus main body is installed to the container installed part, the fixed board engages with the engaging part.

14. The ink container according to claim 11, wherein the container installed part is provided in an apparatus main body, the container installed part further includes a protrusion on a face adjacent to another face on which the RFID sensing circuit board is provided at a position according to a specification of the apparatus main body, the engaging part of the ink container is provided by hollowing a wall adjacent to the one wall toward the internal side of the container case at a position according to the specification of the apparatus main body, and when the ink container being consistent in the specification of the apparatus main body is installed to the container installed part, the protrusion engages with the engaging part.

15. The ink container according to claim 11, wherein a plurality of the ink containers and a plurality of the container installed parts respectively corresponding to ink colors, the container installed part further includes a plurality of fixing holes bored in a face adjacent to another face on which the RFID sensing circuit board is provided, and a fixed board fixed to one or more of the fixing holes selected according to the container installed part and protruded from the face adjacent to the other face on which the RFID sensing circuit board is provided, the engaging part of the each ink container is provided by hollowing a wall adjacent to the one wall toward the internal side of the container case at a different position from other ink containers, when the ink container is installed to the container installed part being consistent in the ink color, the fixed board engages with the engaging part.

16. The ink container according to claim 11, wherein the pouch pack is made of a film material formed by laminating resin and aluminum.

17. The ink container according to claim 11, wherein the engaging part is configured to stop an end at the rear side of the pouch pack in the installing direction in an engaged state.

18. The ink container according to claim 11, wherein the engaging part is provided to extend to the one wall from a wall adjacent to the one wall.

19. The ink container according to claim 11, wherein the engaging part is provided on all of a plurality of walls adjacent to the one wall of the container case.

20. The ink container according to claim 11, wherein the engaging part is provided on a part of a plurality of walls adjacent to the one wall of the container case.

* * * * *